US012152459B1

(12) United States Patent
Kroesen et al.

(10) Patent No.: US 12,152,459 B1
(45) Date of Patent: Nov. 26, 2024

(54) ELECTRICALLY ACTUATED ANNULAR SYSTEM AND METHOD FOR USE IN BLOWOUT PREVENTER

(71) Applicant: Schlumberger Technology Corporation, Sugar Land, TX (US)

(72) Inventors: Gerrit Kroesen, Sugar Land, TX (US); Bruce Boulanger, Sugar Land, TX (US); Suman Katanguri, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/491,042

(22) Filed: Oct. 20, 2023

(51) Int. Cl.
*E21B 33/06* (2006.01)

(52) U.S. Cl.
CPC ..... *E21B 33/061* (2013.01)

(58) Field of Classification Search
CPC ..... E21B 33/06
See application file for complete search history.

(56) References Cited

U.S. PATENT DOCUMENTS 1,839,394 A 1/1932 Inge
2,855,172 A 10/1958 Jones
3,321,217 A 5/1967 Ahlstone
4,095,805 A 6/1978 Allen
4,372,026 A * 2/1983 Mosing ..... E21B 19/164 81/57.2
4,458,876 A * 7/1984 Schaeper ..... E21B 33/06 251/1.2
4,715,456 A 12/1987 Poe, Jr.
6,998,724 B2 2/2006 Johansen
7,156,183 B2 1/2007 Williams
7,159,662 B2 1/2007 Johansen
7,395,855 B2 7/2008 Ayling
7,779,918 B2 8/2010 Cowie
7,798,466 B2 9/2010 Springett
8,316,872 B1 11/2012 Milanovich
8,381,819 B2 2/2013 Fern
(Continued)

FOREIGN PATENT DOCUMENTS

EP 2864579 A1 4/2015
EP 3039226 A2 7/2016
(Continued)

*Primary Examiner* — Kipp C Wallace
(74) *Attorney, Agent, or Firm* — Kelly McKinney

(57) ABSTRACT

A technique facilitates reliable operation of a blowout preventer (BOP) system in a wide range of challenging environments. To enable dependable and rapid closing of the internal passageway of the BOP system, an annular closing system is employed. The annular closing system is fully electrically actuated and may comprise a variety of components which cooperate to provide reliable sealing of the internal passageway. Examples of those components comprise a packer which may be compressed inwardly to seal off flow along the interior passage. Additionally, a pusher mechanism is positioned in the annular closing system and is shiftable, e.g. linearly shiftable, such that its motion causes the packer to be compressed in the radially inward direction. At least one electrically operated rotary-to-linear actuator is actuatable to move the pusher mechanism when causing compression of the packer.

14 Claims, 7 Drawing Sheets

(56) References Cited

U.S. PATENT DOCUMENTS

| | | | |
|---|---|---|---|
| 8,621,958 | B2 | 1/2014 | Biester |
| 8,657,011 | B2 | 2/2014 | Vyas |
| 8,776,892 | B2 | 7/2014 | Fern |
| 9,019,118 | B2 | 4/2015 | Milne |
| 9,388,657 | B2 | 7/2016 | Nelson |
| 9,388,888 | B2 | 7/2016 | Eriksen |
| 9,494,007 | B2 | 11/2016 | Bourgeau |
| 9,581,266 | B2 | 2/2017 | Eriksen |
| 9,627,940 | B2 | 4/2017 | Eriksen |
| 9,631,455 | B2 | 4/2017 | Geiger |
| 9,797,216 | B2 | 10/2017 | Rosa |
| 9,822,600 | B2 | 11/2017 | Bourgeau |
| 10,287,841 | B2 | 5/2019 | Zonoz |
| 10,301,897 | B2 | 5/2019 | Arteaga |
| 10,316,605 | B2 | 6/2019 | Bourgeau |
| 10,329,865 | B1 | 6/2019 | Baugh |
| 10,370,914 | B2 | 8/2019 | Angstmann |
| 10,415,339 | B2 | 9/2019 | Garro |
| 10,465,466 | B2 | 11/2019 | Angstmann |
| 10,487,587 | B2 | 11/2019 | Cummins |
| 10,570,689 | B2 | 2/2020 | Jaffrey |
| 10,597,966 | B2 | 3/2020 | Jones |
| 10,648,268 | B2 | 5/2020 | Jaffrey |
| 10,689,933 | B2 | 6/2020 | Deul |
| 10,724,324 | B2 | 7/2020 | Boulanger |
| 10,801,292 | B2 | 10/2020 | Biester |
| 10,900,347 | B2 | 1/2021 | Amsellem |
| 11,060,372 | B2 | 7/2021 | Bourgeau |
| 11,066,892 | B2 | 7/2021 | Gallagher |
| 11,098,551 | B2 | 8/2021 | Angstmann |
| 11,136,853 | B2 | 10/2021 | Zonoz |
| 11,156,054 | B2 | 10/2021 | Alsup |
| 11,339,624 | B2 | 5/2022 | Angstmann |
| 2004/0056229 | A1* | 3/2004 | Biester ..... F16K 31/53 251/129.11 |
| 2010/0006298 | A1 | 1/2010 | Voss |
| 2013/0175045 | A1 | 7/2013 | Rytlewski |
| 2013/0199801 | A1 | 8/2013 | Johnson |
| 2013/0199802 | A1 | 8/2013 | Weir |
| 2013/0220637 | A1 | 8/2013 | Fabela |
| 2014/0354096 | A1* | 12/2014 | Eriksen ..... H02K 3/28 310/80 |
| 2015/0152705 | A1 | 6/2015 | Jaffrey |
| 2016/0290526 | A1 | 10/2016 | Easter |
| 2017/0058623 | A1 | 3/2017 | Jaffrey |
| 2017/0130562 | A1 | 5/2017 | Jaffrey |
| 2017/0218717 | A1 | 8/2017 | Brinsden |
| 2019/0145217 | A1 | 5/2019 | Alsup |
| 2019/0338614 | A1 | 11/2019 | Angstmann |
| 2020/0072012 | A1* | 3/2020 | Angstmann ..... H02K 5/132 |
| 2020/0115987 | A1 | 4/2020 | Rome |
| 2021/0180427 | A1* | 6/2021 | Zonoz ..... E21B 33/127 |
| 2021/0189826 | A1 | 6/2021 | Gallagher |
| 2021/0340833 | A1 | 11/2021 | Angstmann |
| 2021/0372224 | A1 | 12/2021 | Tyler |
| 2022/0136356 | A1 | 5/2022 | Poveda |
| 2022/0389784 | A1 | 12/2022 | Katanguri |

FOREIGN PATENT DOCUMENTS

| | | | |
|---|---|---|---|
| EP | 3099934 | A1 | 12/2016 |
| EP | 3822514 | A1 | 5/2021 |
| GB | 2517959 | A | 3/2015 |
| NO | 343133 | B1 | 11/2018 |
| WO | 2017042152 | A1 | 3/2017 |

* cited by examiner

ELECTRICALLY ACTUATED ANNULAR SYSTEM AND METHOD FOR USE IN BLOWOUT PREVENTER

BACKGROUND

In many oil and gas well applications, various types of equipment may be used to contain and isolate pressure in the wellbore. For example, a blowout preventer system may be installed on a wellhead to protect against blowouts. The blowout preventer has a longitudinal interior passage which allows passage of pipe, e.g. drill pipe, and other well components. Additionally, the blowout preventer has a variety of features including rams, e.g. blowout preventer pipe rams and shear rams, which facilitate rapid well closing and sealing operations. Control over operation of the blowout preventer generally is achieved with various types of hydraulic controls. However, as deeper subsea wells and other types of deep wells are developed, the blowout preventer systems are required to operate in more challenging environments while at the same time improving operational availability. These challenging environments and increased requirements can render the hydraulic operating system susceptible to failure.

SUMMARY

In general, a system and method facilitate reliable operation of a blowout preventer (BOP) system in a wide range of challenging environments. To enable dependable and rapid closing of the internal passageway of the BOP system, an annular closing system is employed. The annular closing system is fully electrically actuated and may comprise a variety of components which cooperate to provide reliable sealing of the internal passageway. Examples of those components comprise a packer which may be compressed inwardly to seal off flow along the interior passage. Additionally, a pusher mechanism is positioned in the annular closing system and is shiftable, e.g. linearly shiftable, such that its motion causes the packer to be compressed in the radially inward direction. At least one electrically operated rotary-to-linear actuator is actuatable to move the pusher mechanism when causing compression of the packer.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
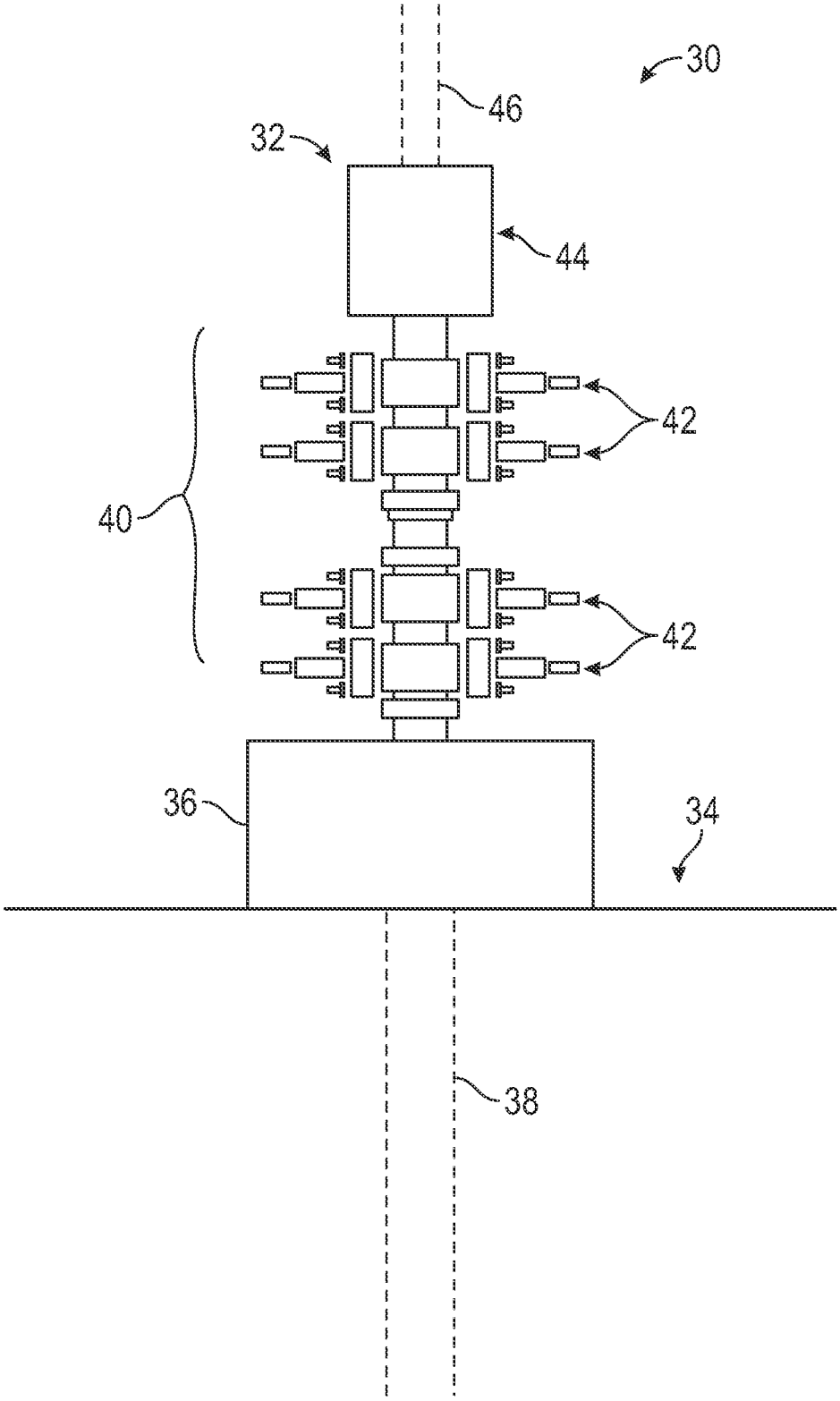
FIG. 1 is an illustration of an example of an annular closing system implemented in an overall well BOP system mounted on a wellhead above a borehole, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and method which facilitate reliable operation of a blowout preventer (BOP) system in a wide range of challenging environments. For example, the BOP system may be employed in various challenging surface environments and subsea environments where the BOP system may be operated to seal, control, and monitor a hydrocarbon well. Reliable operation in these types of environments is enhanced by constructing the BOP system as an electrically actuated system. This further allows well operators to move away from traditional, hydraulically powered BOP equipment.

To enable dependable and rapid closing of an internal passageway of the BOP system, an electronically actuated annular closing system is employed. The annular closing system may be actuated solely by electrical power without hydraulic actuation. Accordingly, the annular closing system utilizes a variety of components which cooperate to provide the reliable sealing of the internal passageway upon appropriate electrical input. Examples of those components comprise a packer which may be compressed inwardly to seal off flow along the interior passage. Additionally, a pusher mechanism is positioned in the annular closing system and is shiftable, e.g. linearly shiftable, such that its motion causes the packer to be compressed in the radially inward direction. At least one electrically operated rotary-to-linear actuator is actuatable to move the pusher mechanism when causing compression of the packer. For example, a plurality of electrically operated rotary-to-linear actuators may be selectively actuated to move the pusher mechanism linearly so as to compress the packer and seal off the internal passageway.

In a specific embodiment, the electric annular closing system comprises an annular body containing the packer with a donut surrounding the packer. By way of example, the donut may be made from a suitable elastomeric material. A pusher mechanism, e.g. a pusher plate, is positioned within the annular closing system body such that linear movement of the pusher mechanism squeezes the donut. The linear movement may be in a direction generally parallel with an axis along the internal passageway of the BOP system. As the donut is squeezed by the pusher mechanism, the elastomeric material is forced inwardly which causes the packer to be compressed in a radially inward direction. Upon sufficient movement of the pusher mechanism, the packer is transitioned to a fully sealed position blocking flow along the internal passageway.

The electric annular closing system further comprises at least one electrically operated rotary-to-linear actuator which may be actuated to move the pusher mechanism linearly when causing compression of the packer. By way of example, a plurality of the electrically operated rotary-to-linear actuators may be used collectively to cause the desired movement of the pusher mechanism. In some embodiments, an electric motor assembly(ies) of the at least one electrically operated rotary-to-linear actuator may be positioned within the annular body. However, other embodiments position the electric motor assembly(ies) of the at least one electrically operated rotary-to-linear actuator externally of the annular body.

Referring generally to FIG. 1, a well system 30 is illustrated as comprising a BOP system 32 for providing pressure control at a well 34. In this example, the BOP system 32 is mounted on a wellhead 36, e.g. a land-based wellhead or a subsea wellhead, located above a borehole 38, e.g. a wellbore. The BOP system 32 may be arranged as a BOP stack 40 and may comprise a variety of BOP components, such as ram BOPs 42 and an annular closing system 44. By way of example, the ram BOPs 42 may comprise pipe rams and shear rams. Additionally, the annular closing system 44 may be mounted above the ram BOPs 42. As described below, the BOP system 32 may have a central, longitudinal passage for receiving tubular components 46, e.g. drill pipe or other pipe, therethrough. The annular closing system 44 is in the form of an electronically actuated annular closing system.

Figure 2:
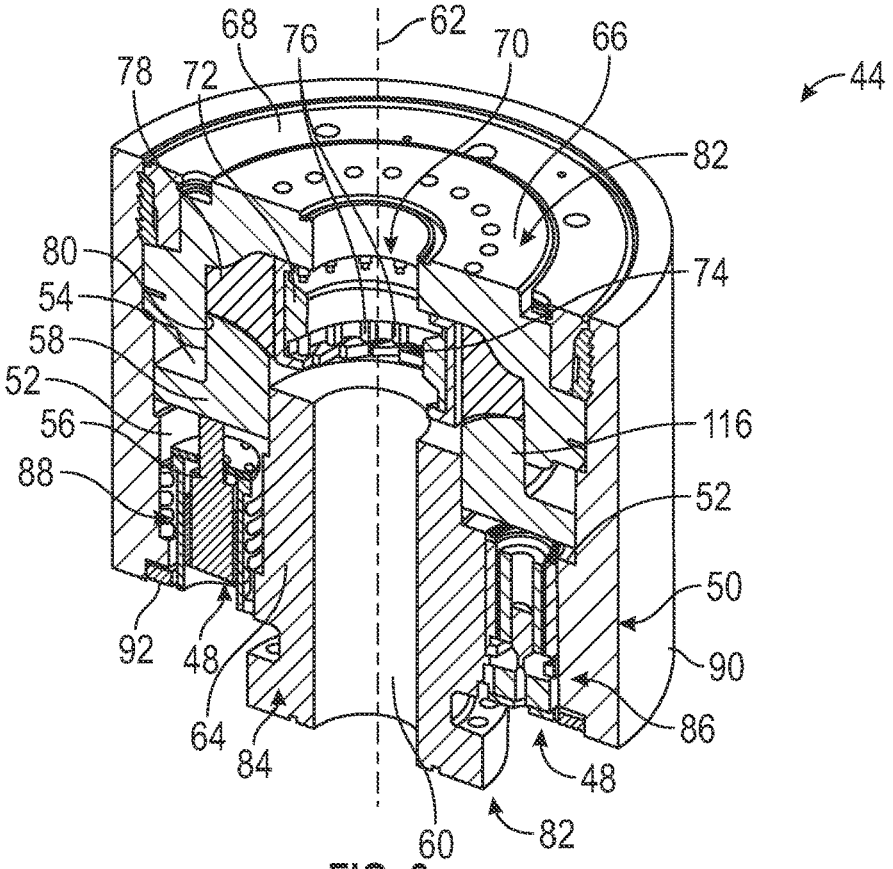
FIG. 2 is a cross-sectional illustration of an example of an annular closing system, according to an embodiment of the disclosure.
Figure 3:
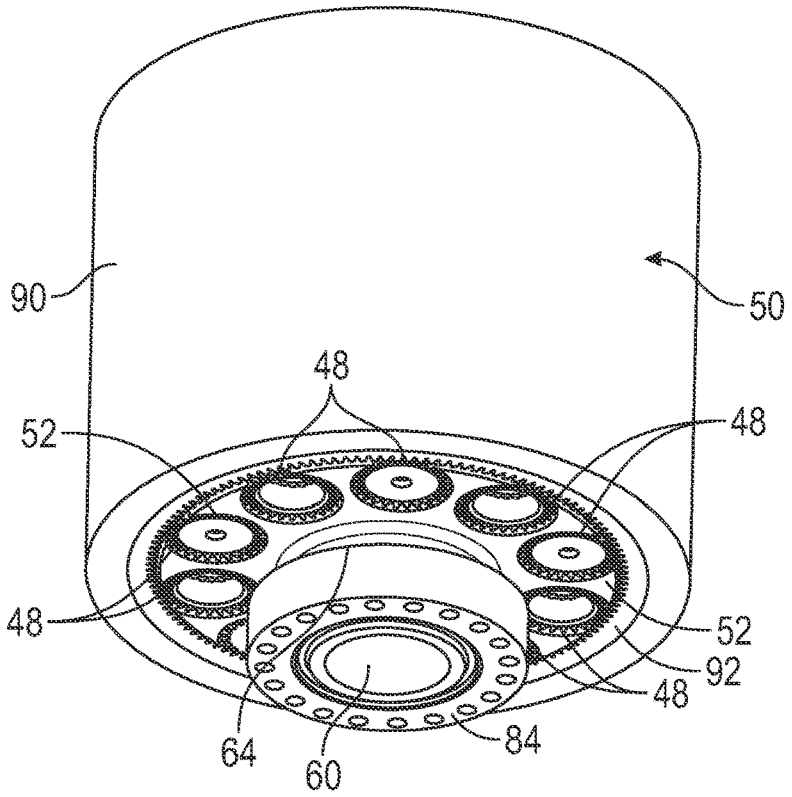
FIG. 3 is an orthogonal view of the annular closing system illustrated in FIG. 2, according to an embodiment of the disclosure.
Figure 4:
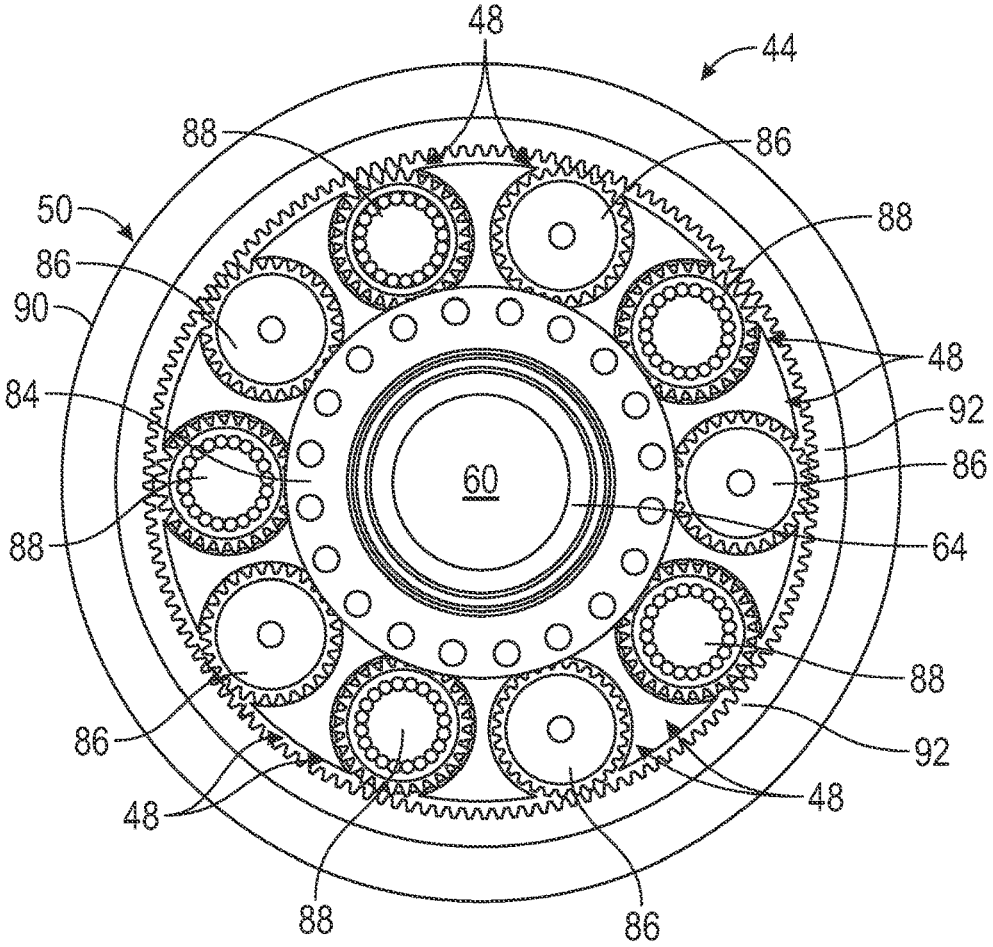
FIG. 4 is a bottom view of the annular closing system illustrated in FIG. 2, according to an embodiment of the disclosure.

Referring generally to FIG. 2, one example of electronic annular closing system 44 is illustrated as being electrically actuatable via at least one electrically operated rotary-to-linear actuator 48 (see also FIGS. 3 and 4). In the specific example illustrated, a plurality of the rotary-to-linear actuators 48 may be employed to cause the desired actuation of annular closing system 44 upon appropriate electrical power input. According to the example illustrated, the annular closing system 44 comprises an annular body 50 which forms the outer structure that supports components of annular closing system 44. In this embodiment, the electrically operated rotary-to-linear actuators 48 are mounted completely within annular body 50 via suitable mounting structures 52, e.g. appropriately sized passages through a base of annular body 50.

In this particular embodiment, a pusher mechanism 54 is mounted in engagement with corresponding pusher rods 56 of electrically operated rotary-to-linear actuators 48. By way of example, the pusher mechanism 54 may be in the form of (or may comprise) a pusher plate 58 against which the pusher rods 56 abut or are otherwise engaged. In some embodiments, the pusher mechanism 54 is engaged by a plurality of the pusher rods 56 which are arranged around a central passageway 60. It should be noted the central passageway 60 is a continuation of the internal passageway extending through BOP system 32.

In the illustrated example, the pusher mechanism 54/58 is linearly slidable in a direction generally parallel with an axis 62 of central passageway 60 while being secured radially between a central body mounting structure 64 and a top structure 66. The top structure 66 may be secured to annular body 50 via, for example, an actuator ring 68 or other suitable fastening mechanism.

According to the embodiment illustrated, the top structure 66 cooperates with annular body 50 to secure a packer 70 therein above the central body mounting structure 64. Packer 70 may have a variety of configurations, but one example utilizes a combination of an elastomeric sealing portion 72 and a metal portion 74, e.g. a steel portion, formed by packer inserts 76 and/or other packer supporting structures. In the illustrated embodiment, packer 70 is surrounded by a donut 78 which may be formed of an elastomeric material or other suitable material able to help form a secure seal within the annular closing system 44.

As illustrated, the pusher mechanism 54 is movably positioned between the pusher rods 56 of electrically operated rotary-to-linear actuators 48 and the donut 78. Additionally, the donut 78 is constrained via an internal wall 80 of top structure 66. Accordingly, when pusher rods 56 are linearly actuated via electrically operated rotary-to-linear actuators 48, the pusher mechanism 54 is moved in a linear direction toward donut 78, e.g. in a direction parallel with axis 62. This linear movement of pusher mechanism 54 causes the elastomeric donut 78 to be squeezed.

This squeezing action within the constraints of internal wall 80 further causes the donut 78 to expand radially inwardly and to thus drive the packer 70 in a radially inward direction. Upon sufficient squeezing of donut 78, the packer 70 is forced to a set, sealed position against tubular 46 or to a sealed position within an empty central passageway 60. Regardless, flow along central passageway 60 is blocked once the packer 70 is actuated to the set/closed position.

It should be noted the electronic annular closing system 44 may be connected to various other components which may be part of the overall BOP system 32. Accordingly, the electronic annular closing system 44 may comprise mounting features 82 constructed for coupling with adjacent components. Examples of mounting features 82 include flanges 84, mounting studs/bolts, or other mounting features.

By way of example, each electrically operated rotary-to-linear actuator 48 may comprise a motor assembly 86 which works in cooperation with a screw assembly 88. The motor assemblies 86 receive appropriate electrical power so as to drive the corresponding screw assemblies 88 during actuation of the annular closing system 44. In the embodiment illustrated in FIGS. 2-5, each motor assembly 86 and screw assembly 88 is mounted internally within annular body 50. In other words, the motor assemblies 86 and screw assemblies 88 do not extend externally of an outer surface 90 of annular body 50.

In the example illustrated, the number of motor assemblies 86 matches the number of screw assemblies 88, e.g. five of each, however some embodiments may utilize mismatched numbers of motor assemblies 86 and screw assemblies 88. It should be noted the number of motor assemblies 86 and screw assemblies 88 may vary depending on the parameters of a given operation. Additionally, the actuation of screw assemblies 88 via motor assemblies 86 may be synchronized by using a timing gear 92, e.g. a timing ring gear, which synchronizes the action of the screw assemblies 88 in response to operation of the motor assemblies 86.

The motor assemblies 86 may utilize a variety of motors and associated componentry. In the example illustrated in FIG. 5, each motor assembly 86 comprises a motor 94, e.g. a torque motor, which utilizes a torque motor drive adapter 96 to drive a gear reducer 98. The gear reducer 98 is coupled to a drive gear 100 and effectively reduces the rotational speed of the drive gear 100 relative to the motor speed. The drive gear 100 of each motor assembly 86 is coupled with the timing gear 92 which functions to drive the screw assemblies 88 and to ensure synchronization of the screw assemblies 88, thus maintaining even, smooth actuation of pusher mechanism 54.

Similarly, the screw assemblies 88 may be constructed with various components arranged in desired configurations. For example, the screw assemblies 88 may comprise roller screw assemblies, e.g. planetary roller screw assemblies, ball screw assemblies, lead screw assemblies, or other suitable assemblies. In some embodiments, the screw assemblies 88 may be substituted with other configurations of assemblies which are able to convert rotary motion to the linear motion of pusher rods 56.

Figure 5:
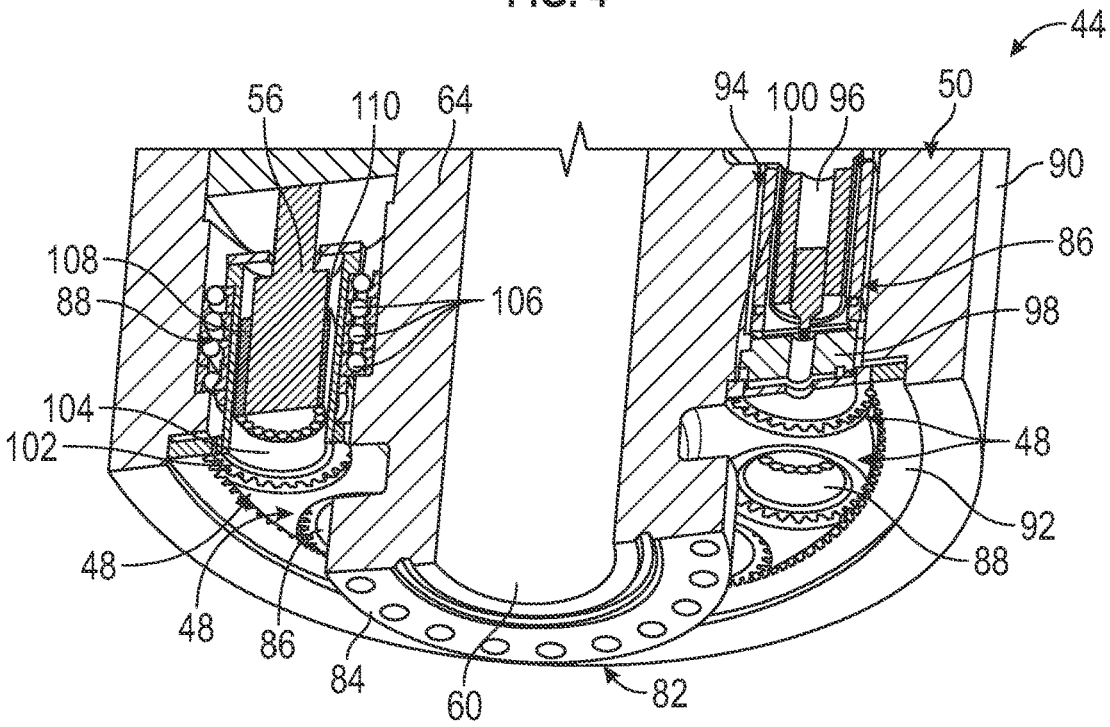
FIG. 5 is a cross-sectional view of a portion of the annular closing system illustrated in FIG. 2, according to an embodiment of the disclosure.

In the example illustrated in FIG. 5, the screw assemblies 88 are in the form of roller screw assemblies and each assembly 88 comprises a roller screw input gear 102 which is driven by timing gear 92. The roller screw input gear 102 drives a nut 104 which is rotatably mounted in corresponding bearings 106. The nut 104 drives a plurality of rollers 108 along a corresponding screw thread 110 located on the exterior of pusher rod 56. This rotational motion of input gear 102, nut 104, and rollers 108 is designed to force linear movement of the corresponding pusher rod 56.

During actuation of annular closing system 44, for example, suitable electric power is provided to motors 94 which drive the timing gear 92. The timing gear 92, in turn, drives the roller screw input gears 102 to provide the rotational motion to screw assemblies 88 as described above. This rotational motion is translated to the corresponding pusher rods 56 which are forced to move linearly in a direction generally parallel with axis 62. This linear movement of pusher rods 56 forces the pusher mechanism 54 in a corresponding linear movement so as to compress donut 78.

As described above, the squeezing of donut 78 in this linear direction combined with the constraint provided by wall 80 forces the donut 78 to expand in a radially inward direction. This radially inward expansion of donut 78 forces actuation of packer 70 in this radially inward direction to, for example, a set position closing off flow through passage 60.

Figure 6:
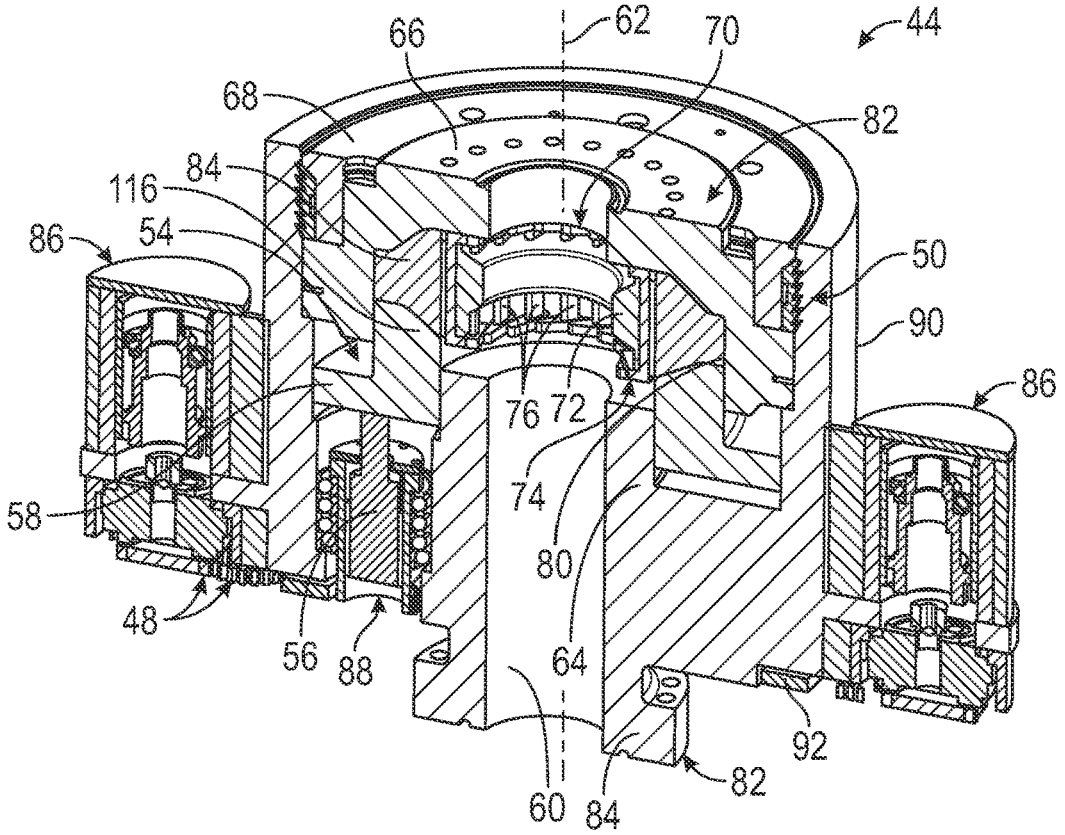
FIG. 6 is a cross-sectional view of another example of the annular closing system, according to an embodiment of the disclosure.

Referring generally to FIG. 6, another embodiment of annular closing system 44 is illustrated. In this example, the motor assembly or assemblies 86 may be mounted externally of annular body 50. For example, a plurality of motor assemblies 86 may be mounted in corresponding external mounting structures 112 which are integrally formed with or coupled to annular body 50. In this example, two motor assemblies 86 are illustrated but other numbers of motor assemblies 86 may be employed. As with the previously described embodiment, the corresponding screw assemblies 88 may be mounted within annular body 50.

Figure 7:
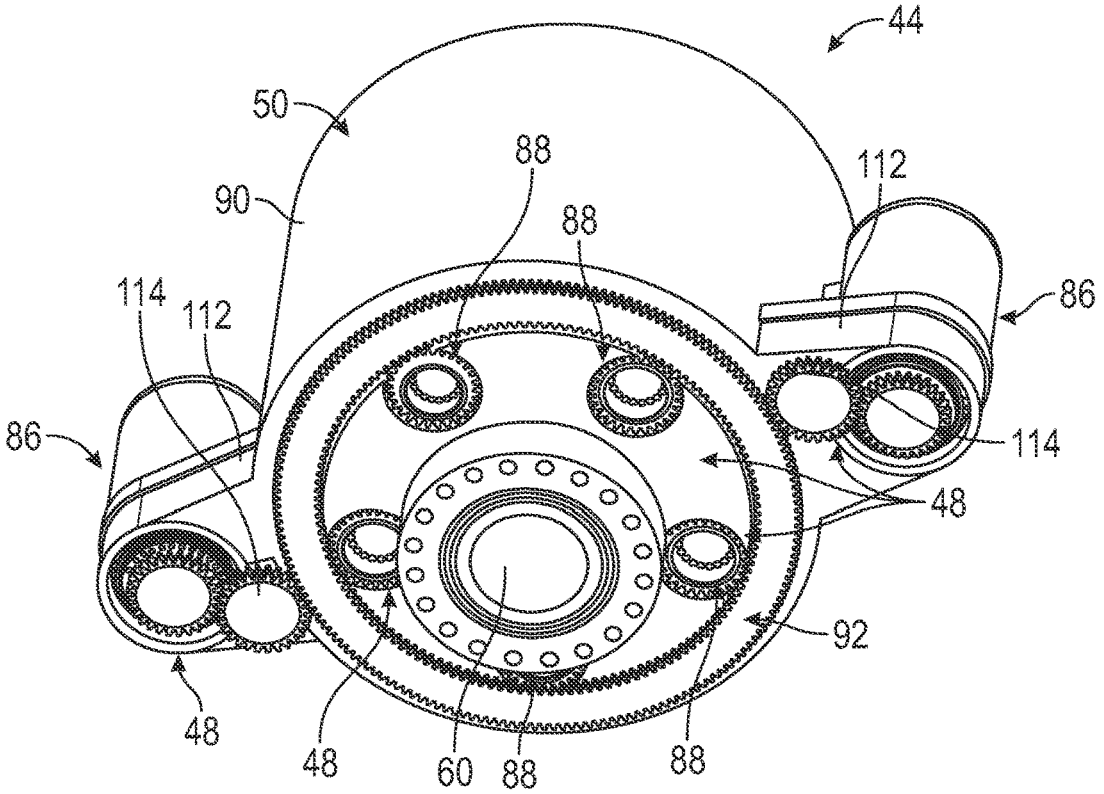
FIG. 7 is an orthogonal view of the annular closing system illustrated in FIG. 6, according to an embodiment of the disclosure.
Figure 8:
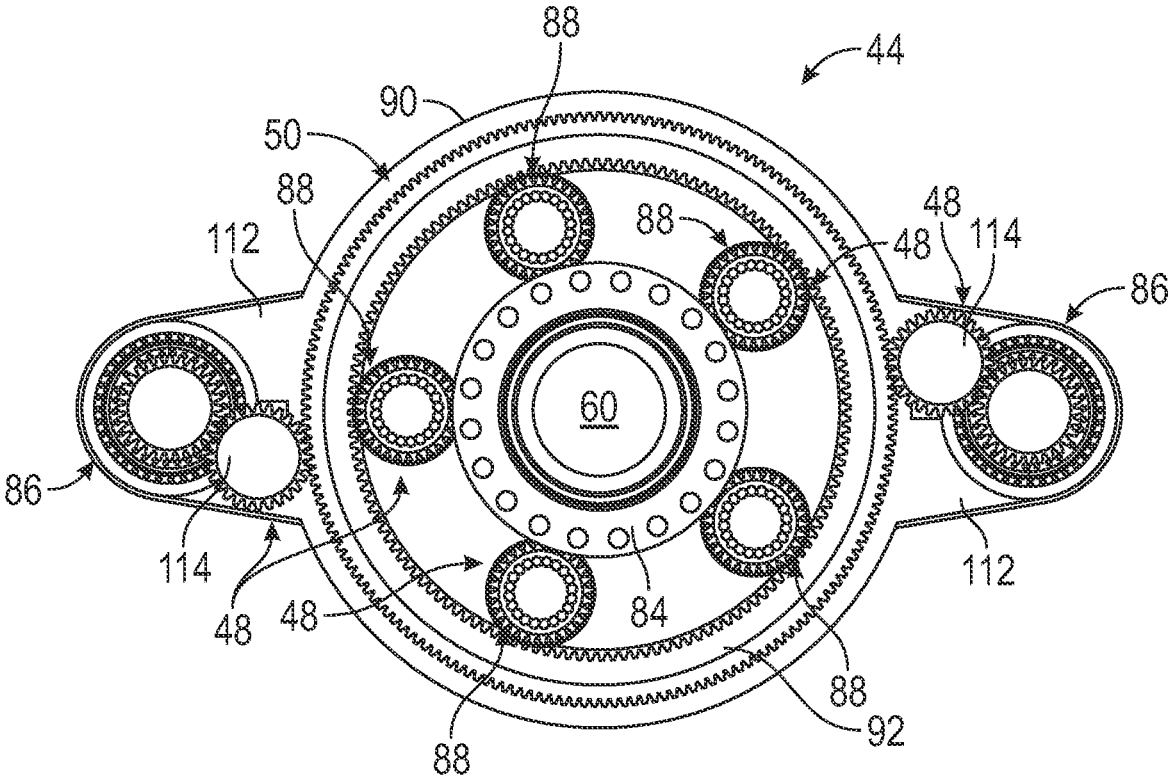
FIG. 8 is a bottom view of the annular closing system illustrated in FIG. 6, according to an embodiment of the disclosure.

It should be noted the number of motor assemblies 86 may be matched with the number of screw assemblies 88. As illustrated, however, the motor assemblies 86 may be used to drive a dissimilar number of screw assemblies 88. In the specific example illustrated, two motor assemblies 86 are used to drive five screw assemblies 88 via timing gear 92 as further illustrated in FIGS. 7 and 8.

Figure 9:
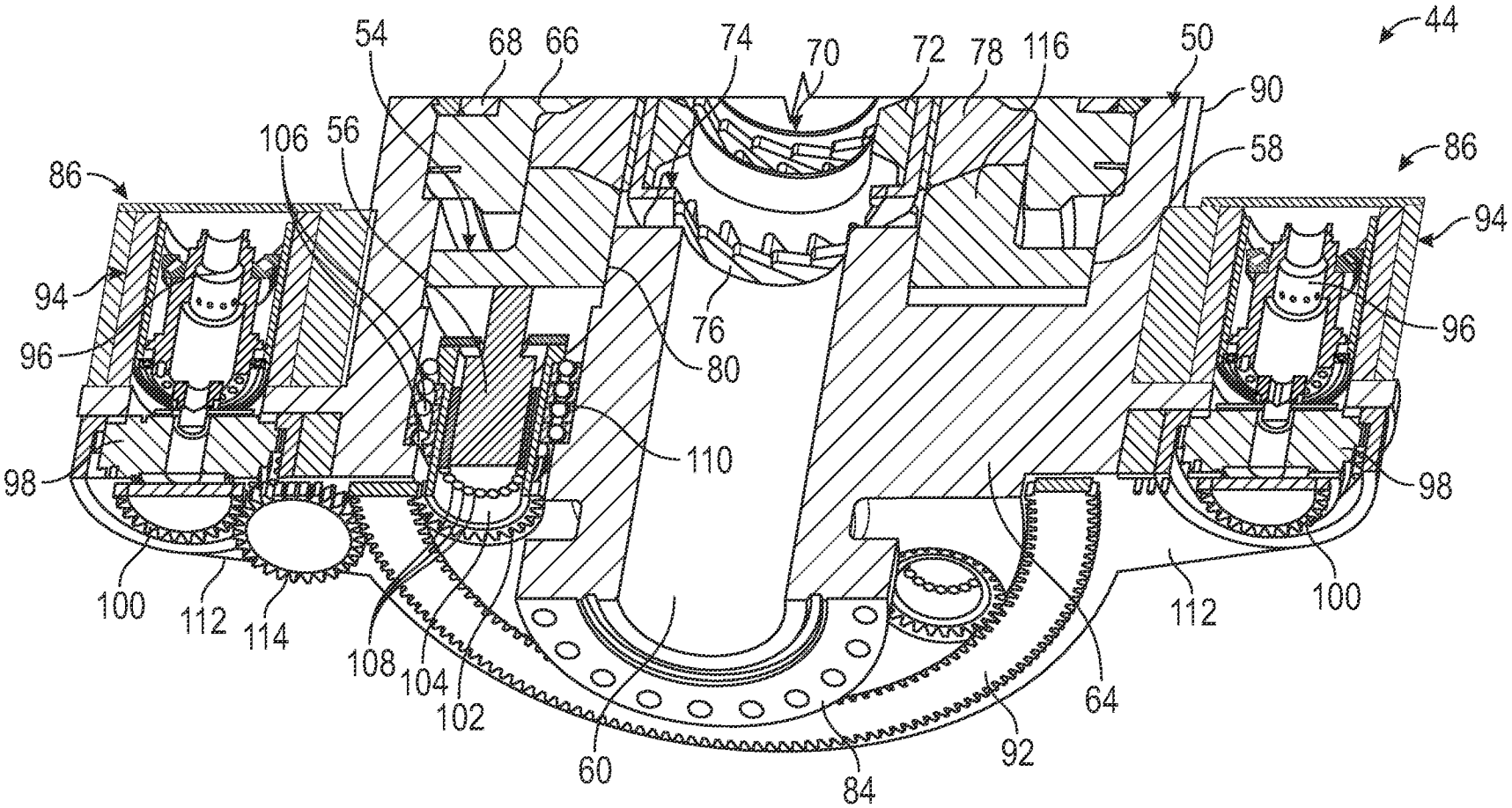
FIG. 9 is a cross-sectional view of a portion of the annular closing system illustrated in FIG. 6, according to an embodiment of the disclosure.

With additional reference to FIG. 9, it will be noted a variety of types of motor assemblies 86 and screw assemblies 88 may be utilized as described above with respect to the embodiment illustrated in FIGS. 2-5. In the present example, the motor assemblies 86 and the screw assemblies 88 are largely similar to those described above and thus common reference numerals have been used to label the components of those assemblies 86/88. In some embodiments, an idler gear 114 is positioned between the drive gear 100 of each motor assembly 86 and the timing gear 92. However, other embodiments may directly engage the drive gears 100 with the timing gear 92.

Figure 10:
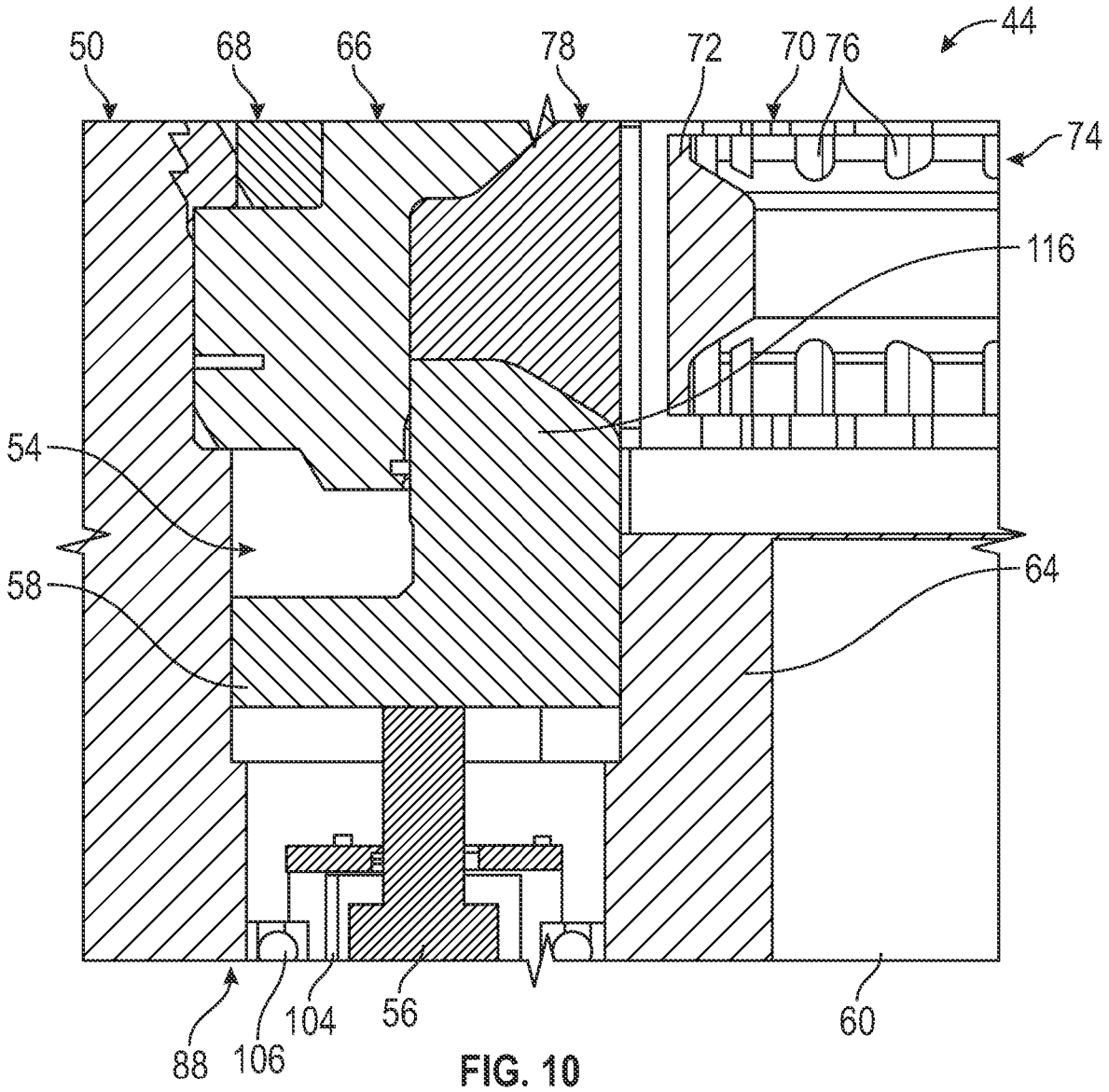
FIG. 10 is a cross-sectional illustration of a portion of a packer and pusher mechanism which may be used in various examples of the annular closing system, according to an embodiment of the disclosure.

Again, during actuation of annular closing system 44, suitable electric power is provided to motors 94 which drive the timing gear 92 via idler gears 114. The timing gear 92, in turn, drives the roller screw input gears 102 to provide the rotational motion to screw assemblies 88 as described above. This rotational motion is translated to the corresponding pusher rods 56 which are forced to move linearly in a direction generally parallel with axis 62. This linear movement of pusher rods 56 forces the pusher mechanism 54 in a corresponding linear movement so as to compress donut 78, as further illustrated in FIG. 10. In the example illustrated in FIG. 10, the pusher mechanism 34 comprises a donut engagement ring member 116 which is structured to engage and facilitate squeezing of donut 78.

As described above, the squeezing of donut 78 in this linear direction combined with the constraint provided by wall 80 forces the donut 78 to expand in a radially inward direction. This radially inward expansion of donut 78 forces actuation of packer 70 in this radially inward direction to, for example, a set position closing off flow through passage 60.

Depending on the specific well operation, well environment, and well equipment, the overall well system 30 may be adjusted and various configurations may be employed. For example, the BOP system 32 may comprise many types of alternate and/or additional components. Additionally, the BOP system 32 may be combined with many other types of wellheads and other well components used in, for example, land-based or subsea hydrocarbon production operations.

Furthermore, the components and arrangement of annular closing system 44 may vary according to the parameters of a given environment and/or well operation. For example, the electric actuation may be achieved by various numbers and arrangements of electrically operated rotary-to-linear actuators 48. The conversion from rotary to linear motion may be achieved via roller screw assemblies, ball screw assemblies, lead screw assemblies, or other types of rotary-to-linear actuators. Additionally, the actuators 48 may be coupled with various types of pusher mechanisms 54 for engaging suitable types of donuts 78. Some embodiments may be constructed without the donut 78 such that the pusher mechanism 54 engages packer 70 directly or through other types of mechanisms. Additionally, packer 70 may have different types, sizes and configurations of elastomeric components, metal components, or other types of components to achieve the desired sealing.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for preventing blowouts at a well, comprising:

a blowout preventer (BOP) system having an annular closing system, the annular closing system comprising:

a packer which may be compressed inwardly to seal off flow along an interior passage of the BOP system;

a pusher mechanism shiftable linearly such that linear movement of the pusher mechanism causes the packer to be compressed inwardly; and at least one electrically operated rotary-to-linear actuator actuatable to move the pusher mechanism linearly, wherein the at least one electrically operated rotary-to-linear actuator comprises at least two electrically operated rotary-to-linear actuators, wherein each of the at least two electrically operated rotary-to-linear actuators comprises an electric motor driving a roller screw assembly which is rotatable to cause linear motion of a corresponding pusher rod.

2. The system as recited in claim 1, wherein the at least one electrically operated rotary-to-linear actuator comprises at least five electrically operated rotary-to-linear actuators.

3. The system as recited in claim 1, wherein the packer is mounted within an annular body of the annular closing system, the at least two electrically operated rotary-to-linear actuators each having a motor assembly mounted within the annular body.

4. The system as recited in claim 1, wherein the packer is mounted within an annular body of the annular closing system, the at least two electrically operated rotary-to-linear actuators each having a motor assembly mounted externally of the annular body.

5. The system as recited in claim 1, wherein the annular closing system comprises a donut surrounding the packer and which is actuatable via the pusher mechanism to compress the packer inwardly, the packer comprising an elastomeric sealing portion.

6. The system as recited in claim 5, wherein the pusher mechanism comprises a pusher plate.

7. The system as recited in claim 1, wherein a timing gear is employed to synchronize the actuation of the roller screw assemblies.

8. The system as recited in claim 6, wherein as the pusher plate moves linearly to squeeze the donut via a donut engagement ring member, the squeezing forces radially inward expansion of the donut which, in turn, forces radially inward compression of the packer.

9. A system for use with a well, comprising:

an annular closing system comprising:

a packer which may be compressed inwardly to seal off flow along an interior passage;

a pusher mechanism which is linearly shiftable such that linear motion of the pusher mechanism causes the packer to be compressed in a radially inward direction; and a plurality of electrically operated rotary-to-linear actuators which are actuatable to shift the pusher mechanism linearly so as to cause the packer to be compressed in the radially inward direction, thus sealing off the interior passage, wherein the plurality of electrically operated rotary-to-linear actuators comprises at least two electrically operated rotary-to-linear actuators, wherein each of the at least two electrically operated rotary-to-linear actuators comprises an electric motor driving a roller screw assembly which is rotatable to cause linear motion of a corresponding pusher rod.

10. The system as recited in claim 9, wherein the annular closing system further comprises a donut surrounding the packer, the donut being positioned for engagement by the pusher mechanism.

11. The system as recited in claim 9, wherein the annular closing system is positioned in a blowout preventer (BOP) stack.

12. The system as recited in claim 9, wherein the packer is mounted within an annular body of the annular closing system, the motors being mounted within the annular body.

13. The system as recited in claim 9, wherein the packer is mounted within an annular body of the annular closing system, the motors being mounted externally of the annular body.

14. A method, comprising:

constructing a BOP system with an annular closing system mounted on a plurality of ram BOPs;

providing the annular closing system with a packer able to compress inwardly to seal off flow along an interior passage of the BOP system;

employing a pusher mechanism which is shiftable to selectively cause the packer to compress inwardly to a sealing position upon sufficient movement of the pusher mechanism; and coupling at least one electrically operated rotary-to-linear actuator to the pusher mechanism to move the pusher mechanism so as to cause the packer to be compressed in the radially inward direction to the sealing position, wherein the at least one electrically operated rotary-to-linear actuator comprises at least two electrically operated rotary-to-linear actuators, wherein each of the at least two electrically operated rotary-to-linear actuators comprises an electric motor driving a roller screw assembly which is rotatable to cause linear motion of a corresponding pusher rod.

* * * * *